US007913599B2

(12) United States Patent
Spaans et al.

(10) Patent No.: US 7,913,599 B2
(45) Date of Patent: Mar. 29, 2011

(54) DEVICE FOR CUTTING THROUGH A BINDING STRIP

(75) Inventors: Johan Spaans, Noord-Scharwoude (NL); Hendrikus Wilhelmus Maria Olivier, Heerhugowaard (NL); Johannes Gerardus Liefting, Alkmaar (NL)

(73) Assignee: Tebulo Industrial Automation B.V., Alkmaar (NL)

( * ) Notice: Subject to any disclaimer, the term of this patent is extended or adjusted under 35 U.S.C. 154(b) by 81 days.

(21) Appl. No.: 11/582,265

(22) Filed: Oct. 17, 2006

(65) Prior Publication Data

US 2007/0095187 A1 May 3, 2007

Related U.S. Application Data

(63) Continuation-in-part of application No. 10/886,092, filed on Jul. 6, 2004, now abandoned.

(30) Foreign Application Priority Data

Jul. 10, 2003 (NL) ..... 1023884

(51) Int. Cl.
*B26D 7/00* (2006.01)

(52) U.S. Cl. ..... 83/749; 83/452; 83/613; 83/758

(58) Field of Classification Search ..... 83/657, 83/909, 746, 749, 751, 758, 762, 451–456, 83/459, 613, 614, 616, 620, 623, 567, 753, 83/460; 30/288; 242/562, 521, 526, 527, 527.1–527.7

See application file for complete search history.

(56) References Cited

U.S. PATENT DOCUMENTS 6,401,582 B1 * 6/2002 Noe et al. ..... 83/176

FOREIGN PATENT DOCUMENTS

| | | |
|---|---|---|
| CA | 2472983 | 1/2008 |
| EP | 1495978 | 8/2007 |

OTHER PUBLICATIONS

European Search Report issued by the European Patent Office in connection with European Patent Application No. 1495978.

* cited by examiner

*Primary Examiner* — Phong H Nguyen
(74) *Attorney, Agent, or Firm* — Cooper & Dunham LLP

(57) ABSTRACT

A device for parting a strip (6) of binding material that has been fitted around an article (5), such as a roll of sheet material or bundle of sections and the like, comprising a housing (1) provided with a support (12) for supporting the device with respect to the article (5), two blades (7, 8) connected to the housing (1), at least one blade (8) of which can be moved with respect to the housing (1), drive means (37) for moving the blades with respect to one another between an open position and a closed position for cutting through and/or snipping through the strip (6) when the housing (1) is bearing on the article, and a clamp (16) for holding the parted strip. The clamp (16) and one of the blades can be brought into interaction with one another to clamp the strip (6) between them.

5 Claims, 4 Drawing Sheets

DEVICE FOR CUTTING THROUGH A BINDING STRIP

REFERENCE TO RELATED APPLICATIONS

The present application is a Continuation in Part of application Ser. No. 10/886,092 filed Jul. 6, 2004 now abandoned, entitled "Device for Cutting Through a Binding Strip", which claims priority of Application No. 1023884 filed in The Netherlands on Jul. 10, 2003, the entire contents of which are herein incorporated by reference.

BACKGROUND OF THE INVENTION

The invention relates to a device for parting a strip of binding material that has been fitted around an article, such as a roll of sheet material or bundle of sections and the like, comprising a housing provided with a support for supporting the device with respect to the article, two blades connected to the housing, at least one blade of which can be moved with respect to the housing, drive means for moving the blades with respect to one another between an open position and a closed position for cutting through and/or snipping through the strip when the housing is bearing on the article, and a clamp for holding the parted strip.

A device of this type is disclosed in EP-A 945 351. In this known device a clamping plate is arranged alongside a movable blade, which clamping plate must ensure, together with an opposing plate rigidly mounted on the housing, that the strip does not fly off under the influence of the pretension therein once it has been cut through. If the pretension in the strip is on the high side, the strip can, however, suddenly rupture completely right at the start of the snipping or cutting operation. The consequence of this can be that the strip ruptured in this way nevertheless flies off because the clamp has not yet been able to grip the strip properly.

SUMMARY OF THE INVENTION

The aim of the present invention is to provide a device of the abovementioned type with which flying off of the strip can be better prevented. Said aim is achieved in that the clamp and one of the blades can be brought into interaction with one another to clamp the strip between them.

With the device according to the present invention it can be guaranteed that the strip is reliably clamped between the clamp and the movable blade. Only then is the definitive cutting or snipping operation carried out.

It is known to make one blade movable with respect to the housing and the other fixed. According to the invention with this arrangement the clamp is accommodated in the housing such that the movable blade comes into interaction therewith during its movement, but before the actual cutting or snipping operation between said movable blade and the fixed blade takes place.

It is furthermore known to provide restraining means on the housing to restrain the strip while the movable blade moves against it. The function of said restraining means is to prevent the strip being pushed along by the movable blade without a cutting or snipping action being obtained. This is important if the fixed blade has a cutting edge that runs in the direction of movement of the movable blade and thus is not able to provide any resting effect itself. According to the present invention the restraining means comprise two restrainers that, transversely to the direction of movement of the blade, are some distance apart such that the movable blade can be moved between them. One of the restrainers can move with respect to the housing, transversely to the support, such that it is possible to take into account a more or less severely curved shape of the strip around the article.

The clamp can be held pressed into the housing under spring pretension, such that when the strip is clamped the clamp can be moved against the spring pretension. Preferably, the clamp and the blade have correspondingly oriented and/or shaped surfaces for clamping the strip between them. The cutting edge of the movable blade is defined by a cutting face that can be slid along a corresponding cutting face of the other blade, as well as a stop face that runs transversely thereto and can be slid along and in contact with a corresponding stop face of the clamp. The strip can be reliably clamped between these stop faces, in particular if the movable blade has a bearing face on the side facing the support and the stop face runs at an acute angle with respect to the bearing face.

To further enhance a reliable retaining action on the strip that has been cut through or snipped through, a pressure foot which is located alongside the clamp can additionally be provided, which pressure foot is designed to provide the effect of pressing the strip against the article. In addition, it is possible that the pressure foot can be pressed against the strip under spring pretension. The pressure foot is preferably on the same side of the blades as the clamp. This ensures that in any event one end of the strip can be reliably held even if the clamp should fail for whatever reason.

The housing can be joined by means of a spring suspension to a cap that has means for fixing the latter to a robot arm and the like. In that case even if the robot arm were unable to follow an imprecise surface of the article satisfactorily, the housing can nevertheless make contact with the article and the strip in the correct manner. In this context it is also advantageous if the housing has resilient supporting means on the support side for engaging on the article.

BRIEF DESCRIPTION OF THE DRAWINGS

The features of the present invention can be more readily understood from the detailed description below with reference to the accompanying drawings wherein.

DETAILED DESCRIPTION

Figure 1:
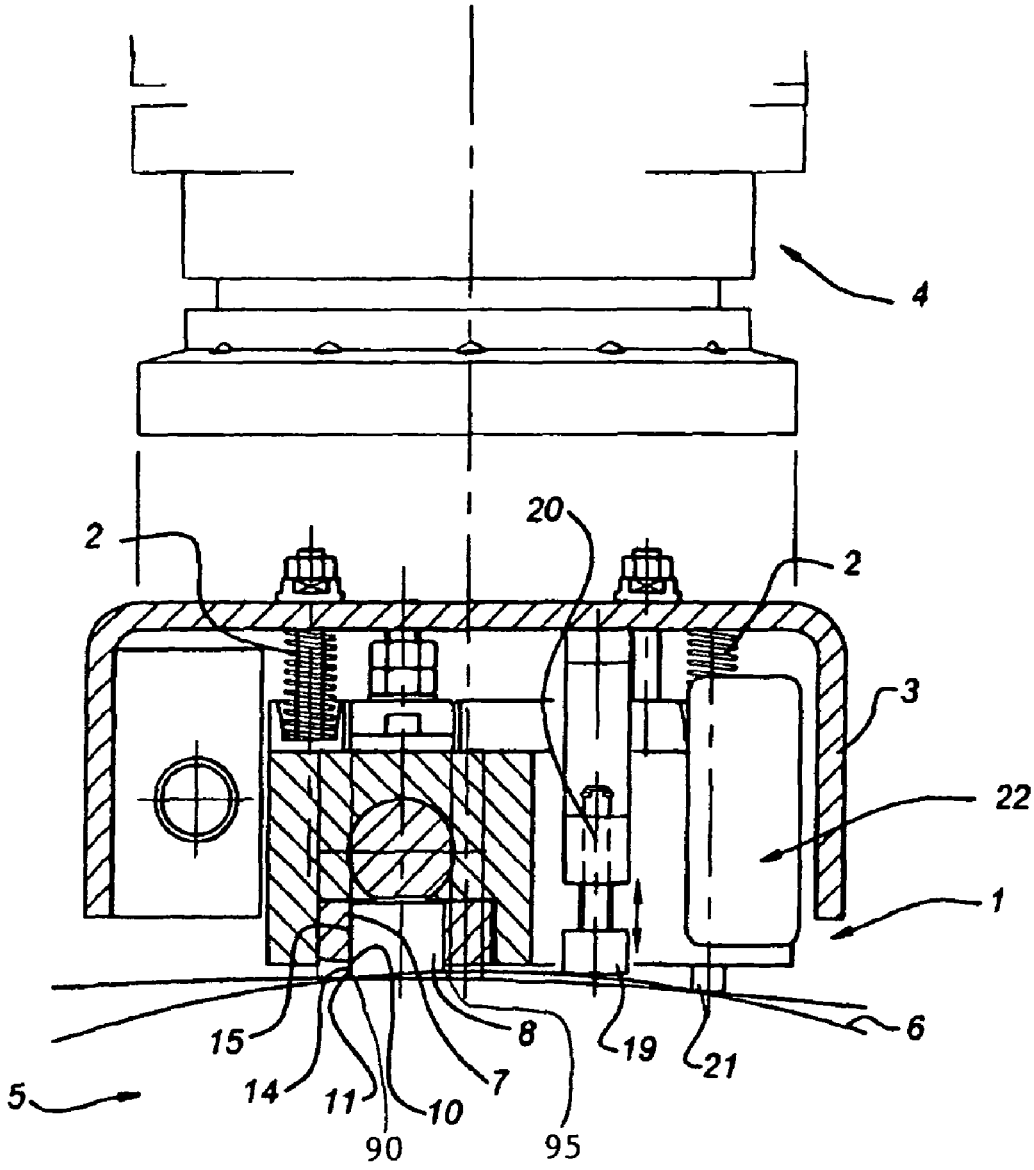
FIG. 1 is a front view of a device for cutting through a binding strip according to an embodiment of the present invention.

The device shown in FIGS. 1-6 comprises a housing 1 that is suspended by means of springs 2 from a cap 3. This cap 3 is attached to the end of a robot arm 4 that is known per se, is not shown in more detail and by means of which the device can be manipulated in the desired manner relative to the article 5. The springs 2, cap 3 and robot arm 4 collectively form a support that supports the housing 1 with respect to the article 5. This article 5 is a roll of sheet material that is kept in the rolled-up state by means of a strip of binding material 6.

Figure 3:
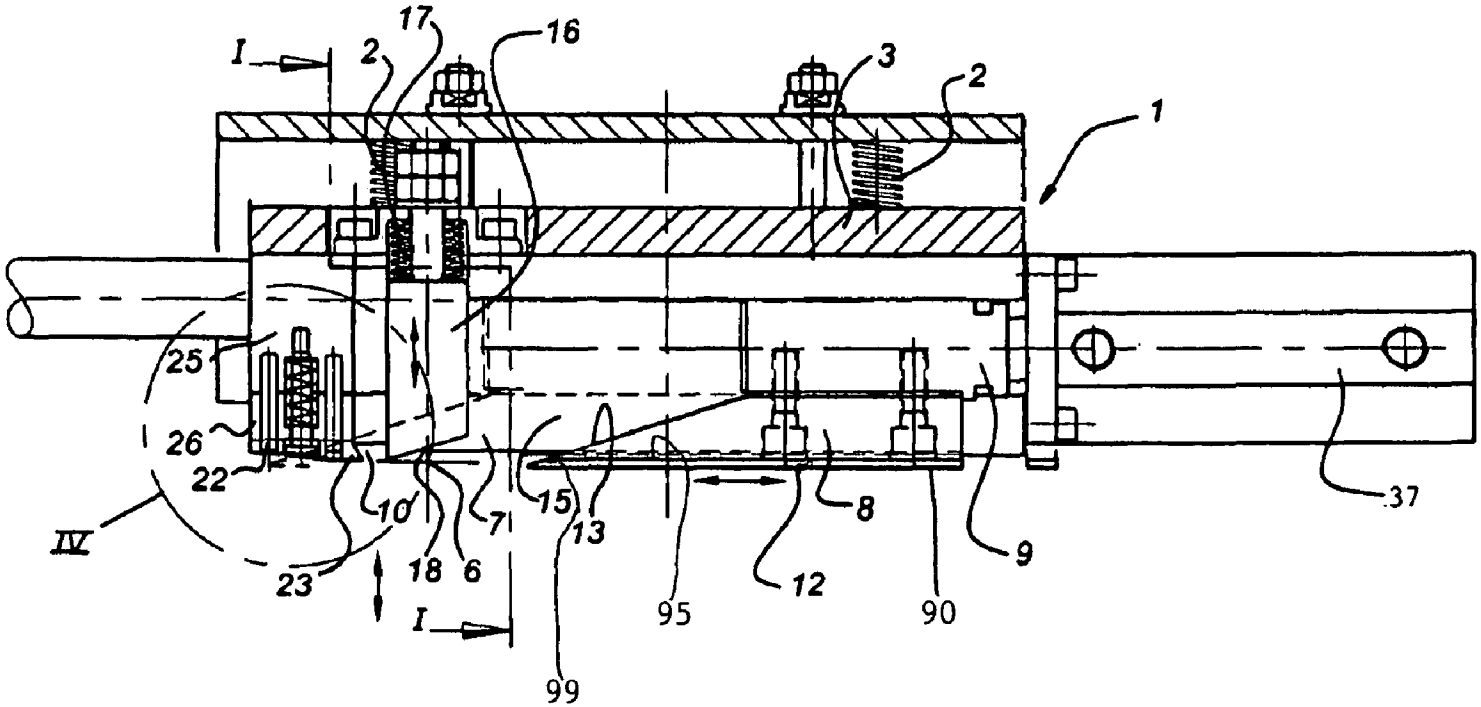
FIG. 3 is a side view of a device for cutting through a binding strip according to an embodiment of the present invention.

The housing 1 has a fixed blade 7 as well as a movable blade 8 that is mounted on the guide 9. The movable blade 8 can be moved back and forth by means of the drive 37 between the retracted position to the right, shown by continuous lines in FIG. 3, and the position in which it has been moved forward to the left, shown by broken lines. In the position in which it has been moved forward, the cutting edge 10 of the fixed blade 7 and the cutting edge 11 located on face 13 of the movable blade 8 have moved along one another, through which movement the strip 6 is cut through. As can be seen in FIG. 3, the cutting edge 10 of the fixed blade 7 is essentially horizontal, that is to say parallel to the bearing face 12, whilst the cutting edge 11 on face 13 of the movable blade 8 runs obliquely and is at an acute angle to the bearing face 12. In this arrangement, as the wedge-shaped blade 8 moves left, it slides underneath strip 6, lifting it towards blade 7 until strip 6 is cut by the cutting edges 10 and 11 of blades 7 and 8.

Figure 2:
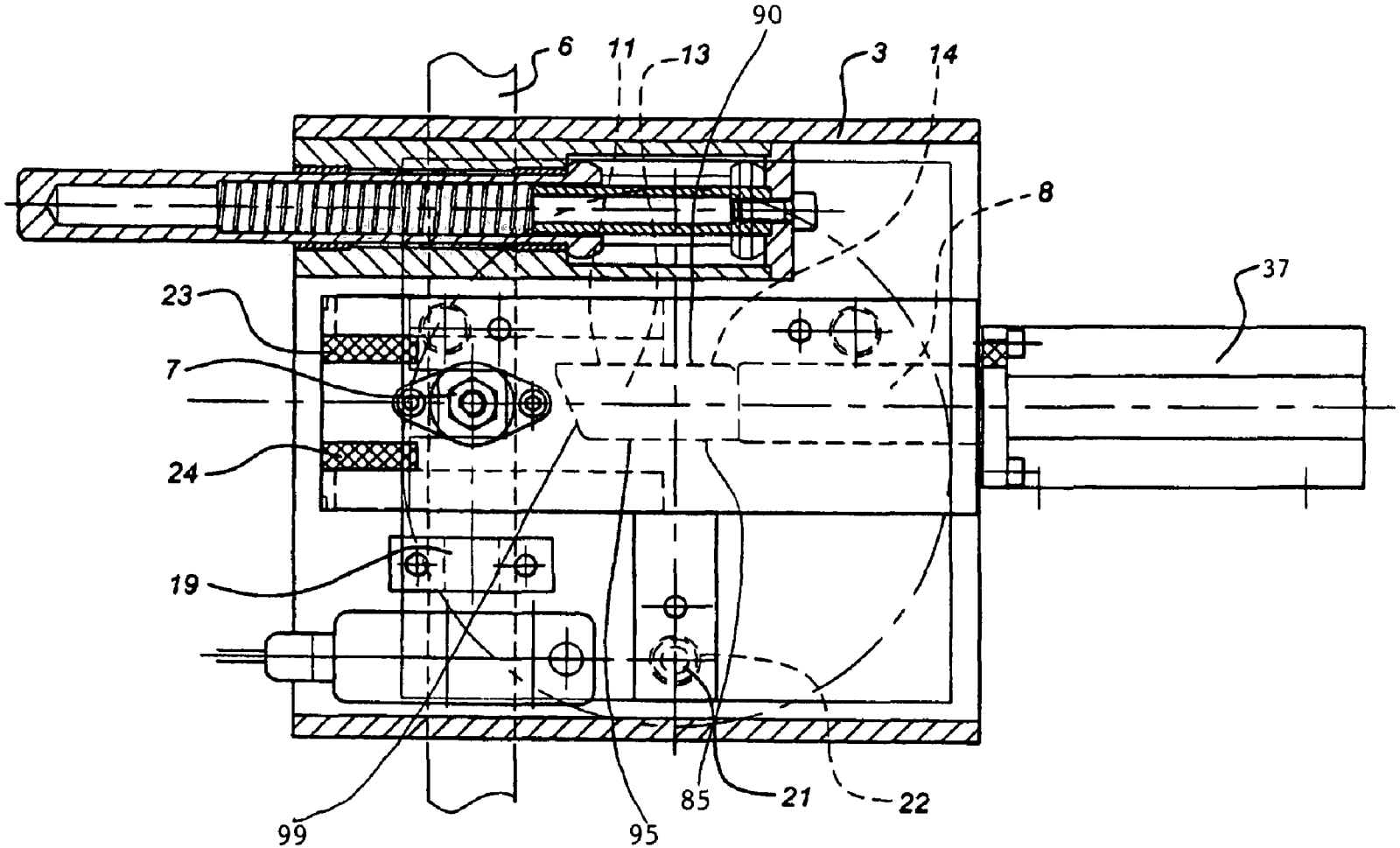
FIG. 2 is a top view of a device for cutting through a binding strip according to an embodiment of the present invention.

In the plan view in FIG. 2, in which the movable blade is shown in the retracted position by broken lines, it can be seen that the blade 8 has a top surface 13. This top surface 13 likewise runs obliquely, analogously to the cutting edge 11. The cutting edge 11 is thus defined by the intersection of face 13 running obliquely upwards and the cutting side 14 of blade 8. Cutting side 14 is perpendicular to the plane of view. Likewise, as shown in FIG. 3, fixed blade 7 has a side 15 that runs in the same direction as the cutting edge 10. Because cutting side 14 of the movable blade 8 is parallel to side 15 of the fixed blade 7, sides 14 and 15 can be moved alongside each other such that a strip 6 can be snipped between cutting edges 10 and 11. Specifically, as shown in FIGS. 1-3, as front edge 99, which is formed by the intersection of bearing surface 12 and top surface 13, of movable blade 8 moves left towards strip 6, front edge 99 is located below strip 6, i.e. between strip 6 and article 5. As front edge 99 passes beneath strip 6, face 13 of moveable blade 8 pushes strip 6 upwards against cutting surface 10 of fixed blade 7. As moveable blade 8 continues to move to the left in FIG. 3, strip 6, which is caught between cutting edge 10 of fixed blade 7 and cutting edge 11 of movable blade 8, is snipped by cutting edges 10 and 11 in a scissor-like action.

Corner 90 is formed by bearing surface 12 and cutting side 14 of movable blade 8. Similarly, corner 95 is formed by bearing surface 12 and opposing side 85 (also of movable blade 8), which is located opposite and approximately parallel to cutting side 14. Because bearing surface 12 is not exactly perpendicular to cutting side 14, corner 90 is slightly lower than corner 95, as can be clearly seen in FIG. 1. Likewise, in FIG. 3, corner 90 is clearly lower than corner 95. Additionally, bearing face 12 can actually be seen in FIG. 3 as the white surface between corners 90 and 95.

Front edge 99 of movable blade 8 is formed by the intersection of bearing surface 12 and top surface 13. Because corner 95 is higher than corner 90, front edge 99 runs obliquely in the view of FIG. 2. This becomes more obvious in FIG. 3 wherein front edge 99, which forms an angle that is less than 90 degrees with respect to cutting side 14, appears to form an even more acute angle with cutting side 14 because corner 95 is higher than corner 90 in this figure. As can be seen more clearly in FIGS. 2 and 6, bearing surface 12 rises upwards as it extends away from cutting side 14, thereby causing the angle of front edge 99 to appear to form a more acute angle with cutting side 14 than it actually does. Front edge 99 is not a cutting surface.

When snipping through or cutting through the strip 6 by means of the blades 7, 8, it is best to hold the ends of the strip 6 firmly to prevent flying off. To this end the clamp 16 is provided in the housing which clamp 16 is held resiliently pressed towards the strip 6 under pretension of the spring 17. The clamp 16 has a lower surface 18 that is shaped correspondingly and runs parallel to the top surface 13 of the movable blade 8. As soon as this blade 8 is moved forwards, towards the strip 6, the latter is clamped between the correspondingly shaped faces 13, 18 of the blade 8 and the clamp 16, such that the strip is secured against flying off. The strip is then cut through as the movement of the blade 8 progresses further.

The pressure foot 19 is provided as a further security measure to prevent the cut through strip 6 from flying off. This pressure foot is located transversely alongside the clamp 16, above the strip 6, as can also clearly be seen in FIGS. 1 and 2. The pressure foot is pressed towards the strip 6 under pretension of the spring 20. This means that when the housing 1 is brought into contact with the article 5 the pressure foot 19 is already pressed, under resilient pretension, against the strip 6 that has not yet been cut through. If, for whatever reason, for example as a consequence of a very high pretension in the strip 6, the latter is not reliably gripped by the faces 13, 18 of the blade 8 and the clamp 16, it is nevertheless ensured that the strip 6 is held clamped between the pressure foot 19 and the article 5.

The housing 1 furthermore has resilient supports 21, with a pin 22 that is in contact with the article 5 under resilient pretension. By this means it is always ensured that the housing 1 is positioned correctly with respect to the article 5 and the strip 6, even if the position by the robot arm 4 is less precise.

Finally, the housing has two restrainers 23, 24. The purpose of these is to restrain the strip 6 should this be displaced when the movable blade 8 moves. As can be seen in FIGS. 2 and 3, when moveable blade 8 contacts strip 6, strip 6 is normally displaced vertically against clamp 16, after which the strip is snipped between cutting surfaces 10 and 11. However, it is possible that the moveable blade 8 will also displace strip 6 horizontally to the left as moveable blade 8 pushes against strip 6. In the event that strip 6 is displaced to the left as moveable blade 8 pushes against strip 6, strip 6 will come into contact with the faces of the restrainers 23, 24, thereby preventing any further horizontal displacement of strip 6.

The restrainers 23, 24 are fixed with respect to the housing 1, and can be held pressed against the article 5. To that end, both restrainers 23, 24 comprise an upper restrainer part 25 and a lower restrainer part 26 which is movable in vertical direction with respect to the upper restrainer part 25.

Figure 4:
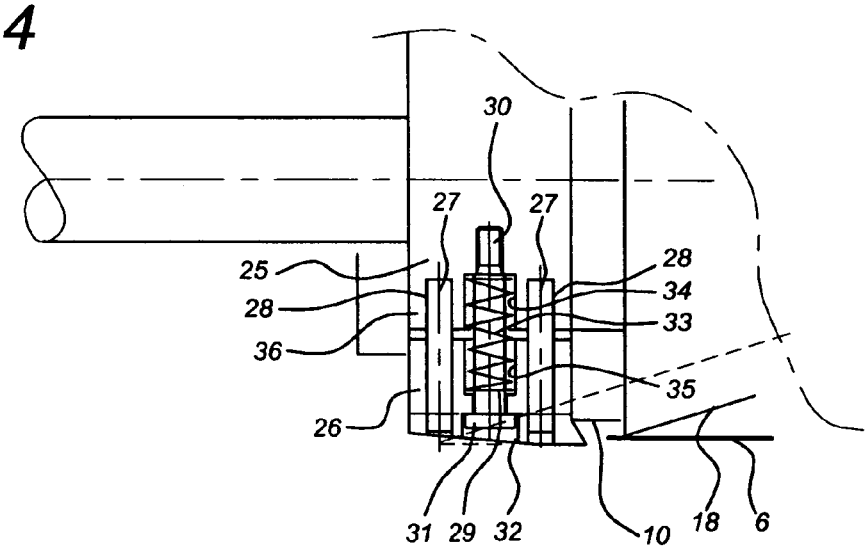
FIG. 4 is a side view of a restrainer, which is part of a device for cutting through a binding strip according to an embodiment of the present invention.
Figure 5:
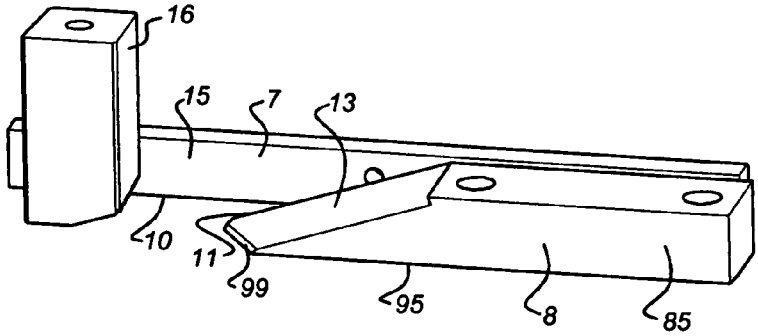
FIG. 5 is a three dimensional view taken from the back of a device for cutting through a binding strip according to an embodiment of the present invention.
Figure 6:
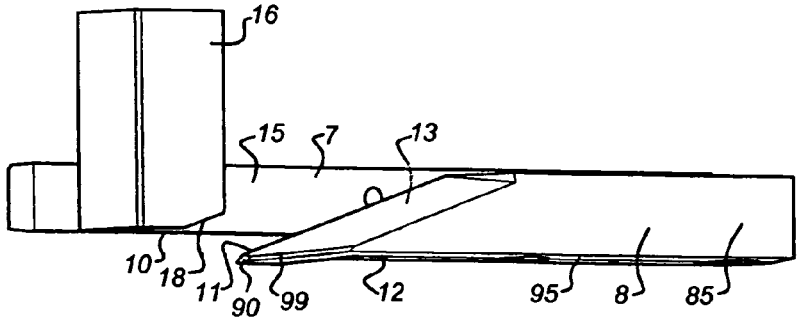
FIG. 6 is a three dimensional view taken from the front of a device for cutting through a binding strip according to an embodiment of the present invention.

In the case of FIG. 3, the lower restrainer part 26 has been pushed upwardly against the upper restrainer part 25. In the case of FIG. 4, the lower restrainer part 26 has been moved downwardly somewhat with respect to the upper restrainer part 25. In this connection, the lower restrainer part 26 comprises two pins 27, which are slidably accommodated in the bores 28 in the upper restrainer part 25.

Furthermore, a bolt 29 is screwed in the screw-threaded hole 30 of the upper restrainer part 25. Said bolt 29 has a head 31, accommodated in a widened hole 32 in the lower restrainer part 26. A compression spring 33 is accommodated in the relatively wide holes, parts 34, 35, of the upper restrainer part 25 and the lower restrainer part 26 respectively. By means of the compression spring 33, the lower restrainer part 26 is constantly urged towards the extended position as shown in FIG. 4. The head 31 prevents the lower restrainer part from being pushed further away. By pressing the lower restrainer part 26 onto a roll to be treated, the lower restrainer part 26 is pushed up to and against the upper restrainer part 25, as shown if FIG. 3.

Thus, the compression spring 33 ensures that the restrainers 23, 24 are held under pretension against the roll, thus providing a correct abutment for the strip 6 to be cut.

What is claimed is:

1. A device for parting a strip of binding material that has been fitted around an article comprising a housing provided with a support for supporting components of the device with respect to the article, two blades connected to the housing, one blade of which is moveable with respect to the housing, the other blade of which is fixed with respect to the housing, drive means for moving the moveable blade between an open position and a closed position with respect to a fixed blade for cutting through and/or snipping through the strip when the housing is bearing on the article, and a spring loaded clamp accommodated in the housing for holding a parted strip, characterized in that the moveable blade moves towards the spring loaded clamp such that they are positioned directly opposite each other to clamp the strip between them when a cutting or snipping operation between the moveable blade and the fixed blade takes place, wherein a cutting edge of the moveable blade is defined by i) a cutting face that slides along a corresponding cutting face of the fixed blade, and ii) a top surface that runs transversely thereto and is slidable along and in contact with a corresponding lower surface of the clamp.

2. The device according to claim 1, wherein the moveable blade has a bearing surface on a side facing the article and the top surface of the moveable blade runs at an acute angle with respect to the bearing surface.

3. The device according to claim 1, further comprising a pressure foot for pressing the strip against the article.

4. The device according to claim 3, wherein the pressure foot is pressed against the strip under spring pretension.

5. The device according to claim 3, wherein the pressure foot is on the same side of the clamp as the moveable blade.

* * * * *